US006971925B1

(12) United States Patent
Orange

(10) Patent No.: US 6,971,925 B1
(45) Date of Patent: Dec. 6, 2005

(54) ROTATABLE CONNECTOR FOR A BATTERY CABLE CLAMP

(75) Inventor: Charles M. Orange, Nashville, TN (US)

(73) Assignee: Batlock, LLC, Nashville, TN (US)

( * ) Notice: Subject to any disclaimer, the term of this patent is extended or adjusted under 35 U.S.C. 154(b) by 0 days.

(21) Appl. No.: 10/894,606

(22) Filed: Jul. 20, 2004

(51) Int. Cl.[7] ..... H01R 4/50
(52) U.S. Cl. ..... 439/773; 439/757; 439/769
(58) Field of Search ..... 439/754, 773, 439/772, 726, 757, 761, 769

(56) References Cited

U.S. PATENT DOCUMENTS 1,696,531 A * 12/1928 Eaton ..... 439/761
1,814,156 A 7/1931 Hedges
1,873,775 A * 8/1932 McMaster et al. ..... 439/761
1,941,773 A 1/1934 Wright
1,977,179 A 10/1934 Fisch
2,878,460 A * 3/1959 Coleman ..... 439/757
3,084,306 A 4/1963 Cribbs
3,521,223 A 7/1970 Martinez
3,838,386 A * 9/1974 Chartrain et al. ..... 439/726
4,385,796 A 5/1983 Eriksson
4,537,460 A * 8/1985 McCaig ..... 439/769
4,555,159 A 11/1985 Chartrain et al.
5,269,709 A 12/1993 Eriksson
5,389,466 A * 2/1995 Inoue et al. ..... 429/178
D363,699 S * 10/1995 Mountfort ..... D13/120
6,773,310 B2 * 8/2004 Davis ..... 439/773
6,802,747 B1 * 10/2004 Orange ..... 439/773

FOREIGN PATENT DOCUMENTS

WO WO 97/03480 1/1997

* cited by examiner

*Primary Examiner*—Hae Moon Hyeon
(74) *Attorney, Agent, or Firm*—Miller & Martin PLLC

(57) ABSTRACT

An improved rotatable battery cable clamp connector is designed for use with applying pressure to legs of the clamp intermediate the cable section and post section of the clamp. Self-lubricating and non-corrosive materials are also used to advantage in the manufacture of the connector.

19 Claims, 6 Drawing Sheets

ROTATABLE CONNECTOR FOR A BATTERY CABLE CLAMP

The present invention relates generally to battery cable clamps and more particularly to an improvement to existing battery cable clamps which facilitates the breaking of corroded connections and the removal of battery cable clamps from the battery post.

BACKGROUND ART

It will be appreciated by those skilled in the art that most automobiles, motorized vehicles and inboard boats are started via battery power and that the standardized modern battery is the 12-volt battery having metal posts for the opposing polarities of the battery to which connector cables are attached. The standard battery cable connector is a yoke-type structure. The typical battery cable is connected to one end of the connector by either crimping or bolt and nut, and the yoke portion of the connector is fitted over the battery post and clamped down onto the battery post by tightening a nut onto a bolt passing through the two ends of the yoke. The yokes are usually made of steel or lead.

Many standard 12-volt batteries will last for several years, especially when used sparingly, as in some recreational boats. During the course of the life of a battery, corrosion buildup may occur and may cause the battery clamp to attach by corrosion to the battery post. Corrosion also tends to build up between the bolt and the nut threaded on the bolt and used to tighten the yoke about the battery post. Corrosion may impair the proper transmission of battery power from the battery post through the battery cable clamp to the battery cable thereby diminishing the electrical power available. To remedy the diminished transmission of power, the battery cable clamp has to be removed, corrosion brushed away and the clamp reamed out so that a solid connection between the clamp and the post can be re-established. This process generally requires loosening of the nut on the bolt clamping the yoke about the post and "breaking" the corrosive seal between the clamp and the post to remove the clamp. In addition, if the battery is spent, the old battery must be removed and replaced with a new one. In these circumstances, once again, the battery cable clamp must be loosened and the seal of the corrosion broken to remove the clamp from the post. Because of the corrosion of the nut to the bolt clamping the yoke to the battery post, either the process of cleaning the battery post and battery cable clamp or replacing the battery can be time consuming and difficult.

What is needed, then, is a battery cable clamp that will overcome the problems with prior art devices. Prior efforts in this regard include those in WO 97/03480 and commonly owned U.S. Ser. No. 10/237,341, and especially the latter design has proved useful in the after market, on yokes with clamping bolts opposite the terminal post from the cable. However, original equipment manufacturers and others utilizing yokes with clamping bolts intermediate the post and the cable and particularly those utilizing steel yokes, may advantageously use an improved design.

SUMMARY OF THE INVENTION

Instead of the standard bolt which passes through the ends of the yoke and nut that is tightened to secure the clamp about the battery post, the battery cable clamp of the invention utilizes a bolt with a clamping handle. The connection between the bolt head and the attached handle includes a boss or camming structure that increases or decreases the clamping pressure of the bolt based on a small rotation of the handle. Thus, the nut on the bolt connecting the two legs of the yoke can be tightened finger tight and the handle rotated approximately half of a turn to substantially increase the clamping pressure of the bolt. When it is desired to remove the battery cable clamp, the handle can be released and a substantial decrease in the clamping pressure of the bolt results. The nut on the bolt can then be easily loosened to relieve additional pressure on the battery cable clamp. The handle may be rotated into an upper locking and unlocking position, and downward to lay upon the surface of the battery. Preferably at least the handle, nut and seat interfacing with the boss on the handle are made of non-corrosive and even non-metallic materials. In this fashion, preferably the entire operation of the invention is possible without the need for using any additional tools.

DETAILED DESCRIPTION OF THE INVENTION

Figure 1:
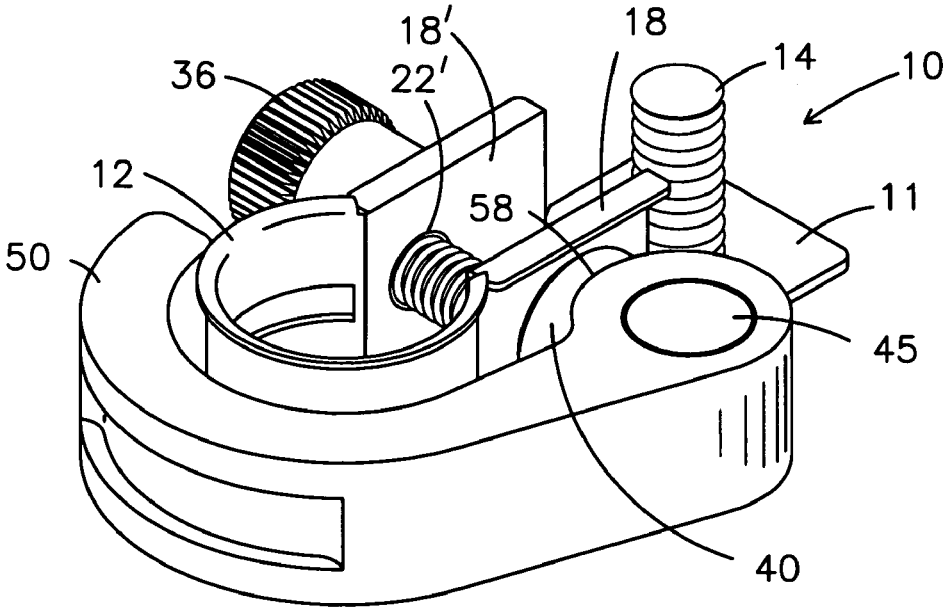
FIG. 1 is a perspective view of the battery cable clamp of the present invention in locked position.

A description of the preferred embodiment of the present invention will be best understood by referring to FIGS. 1–9 of the accompanying drawings wherein like reference numerals refer to like parts.

Figure 9A:
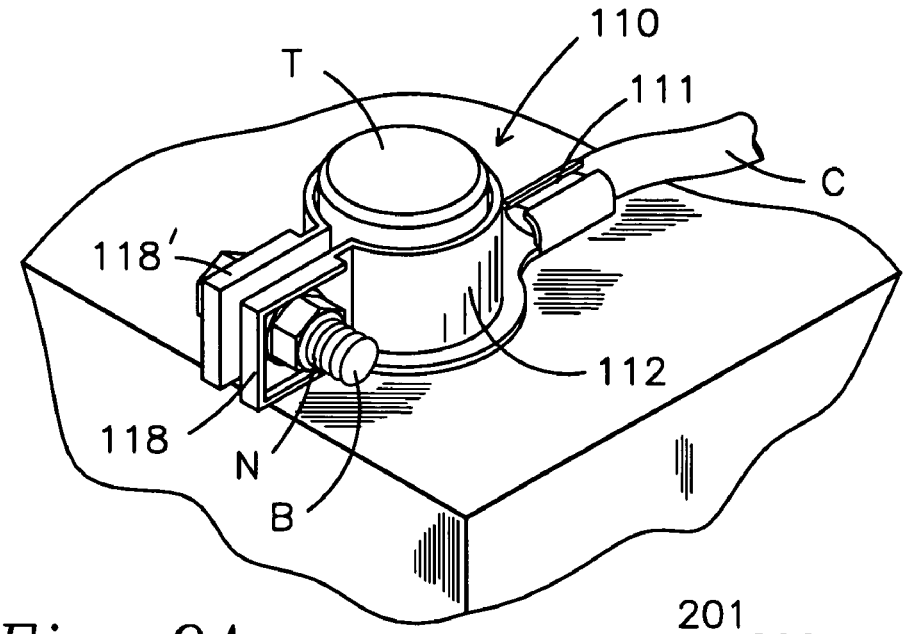
Fig. 9A PRIOR ART
FIG. 9*a* is a prior art battery clamp having a steel connecting yoke and crimped to the battery cable.

Referring first to FIG. 9*a*, prior art steel battery clamp 110 is shown having a first end with crimping section 111 to connect with battery cable C and post section 112 encompassing the battery terminal T and legs 118, 118' extending from each side of the post section of the yoke and having apertures therein to receive a bolt B that is tighten nut N to securely clamp the post section 112 about terminal T. It is to be noted that the nut N and bolt B are at the opposite end of the clamp from the crimping section 111 that connects with cable C.

Figure 9B:
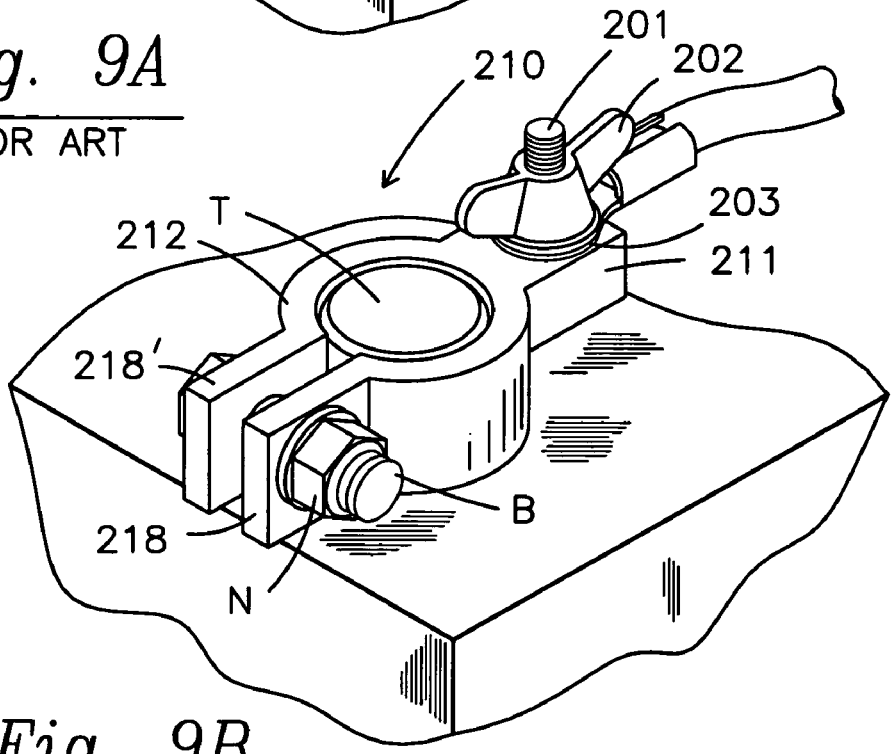
Fig. 9B PRIOR ART
FIG. 9*b* is a prior art lead battery clamp bolted to the battery cable.

Similarly, prior art battery clamp 210 shown in FIG. 9*b* is of a thicker construction typical of battery clamps made from lead rather than steel. This clamp 210 also has a first end 211 that receives bolt 201 passing through the first end 211 and through connector plate 203 attached to battery cable and secured thereto by wing nut 202. Then, a post section 212 substantially encompasses the terminal T of the battery and ends in legs 218, 218' each having an aperture to receive bolt B that is secured thereon by nut N. Nut N is tightened to bring legs 218, 218' closer together and thereby securely fix post section 212 to the terminal T. Most prior art battery cable clamps have utilized this structure with the first end of the clamp being connected to the battery cable and the opposite end of the clamp applying the pressure to secure the post section of the yoke about the terminal T. Particularly as use of steel to manufacture battery cable clamps became more prevalent and the need for thick post section and legs was greatly reduced, it became possible to design battery cable clamps that had a first end connected to the battery cable, a leg section extending to the distal post section and with a returning second leg oriented between the post section and the connection to the cable so that the clamping action was applied by a bolt extending between leg sections intermediate the post section and the cable connecting section of the clamp.

Shown in FIG. 1, is battery clamp 10 of such configuration having a rotatable quick release connector in place of the usual nut and bolt connector. Specifically, battery clamp connector 10 has a first end 11 with a cable joining section. In this case, cable joining section 14 is a threaded post on which cable end plate having an aperture may be mounted and secured with a nut or wing nut. First end 11 extends to first leg section 18 then to post section 12 and back to second leg section 18'. The post section 12 encircles the terminal post of battery and is securely held in place thereon by clamping action applied to legs 18, 18' by a fastener connecting the two through apertures 22, 22' therein. The usual connector is a simple nut and bolt construction that may require a wrench to remove in the ordinary case and in the event of corrosion may be difficult or practically impossible to remove. In FIG. 1, the usual nut and bolt fastener has been replaced with a quick release rotatable connector having a handle 50 with boss 58 resting on seat 40 in locked position to apply pressure via connecting pin 28 to end nut 36 and sandwich legs 18, 18' between the seat 40 and end nut 36. The interior or concave side of handle 50 encircles a substantial portion of the post section 12 in this position.

Figure 2:
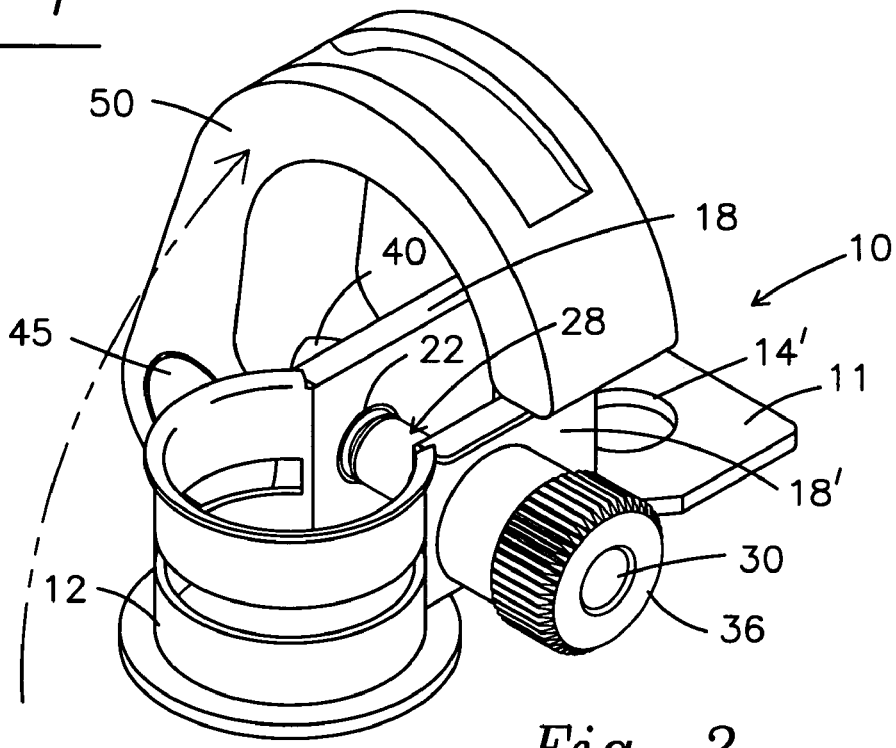
FIG. 2 is a perspective view of the battery cable clamp of FIG. 1 in locked position with the handle rotated upward.

In FIG. 2, the battery clamp is still shown in closed position, however, the handle 50 has been rotated laterally approximately 90° upward from its prior position where it was parallel to the plane of the post section 12 and would be generally laying upon the surface of the battery. In this position, the boss on handle 50 is still exerting pressure against the seat and compressing legs 18, 18' to secure post section 12 of the yoke about the terminal. The battery clamp 10 in FIG. 2 is slightly modified in that the cable connector is a simple aperture 14' to which a cable end may be bolted. It will be understood that a cable end may be attached to a battery clamps in many different ways.

Figure 3:
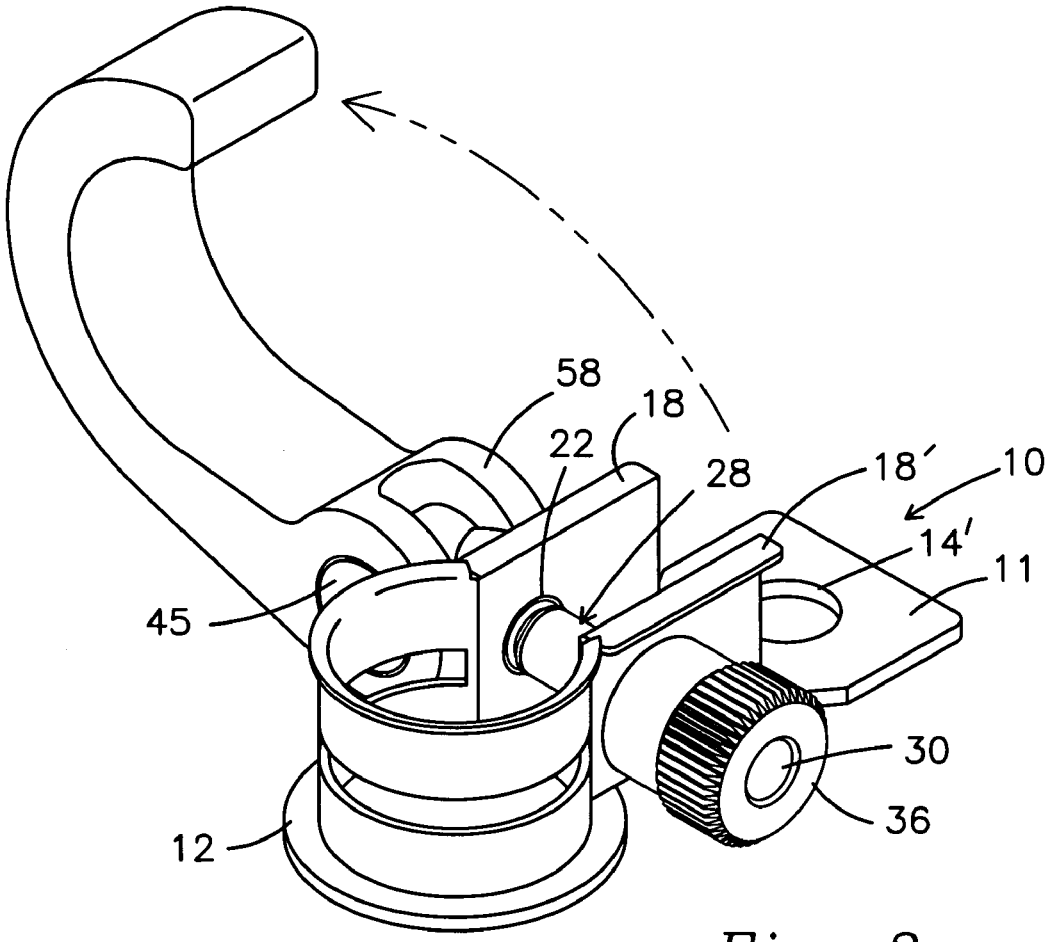
FIG. 3 is a perspective view of the battery cable claim of FIG. 1 in unlocked position.
Figure 4A:
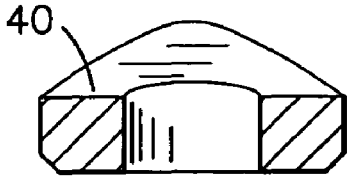
FIG. 4*a* is a side sectional view of a seat according to the present invention.
Figure 4B:
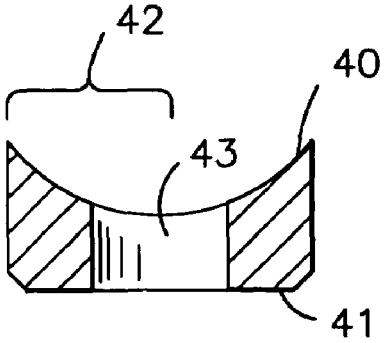
FIG. 4*b* is a front sectional view of the seat of FIG. 4*a*.
Figure 4C:
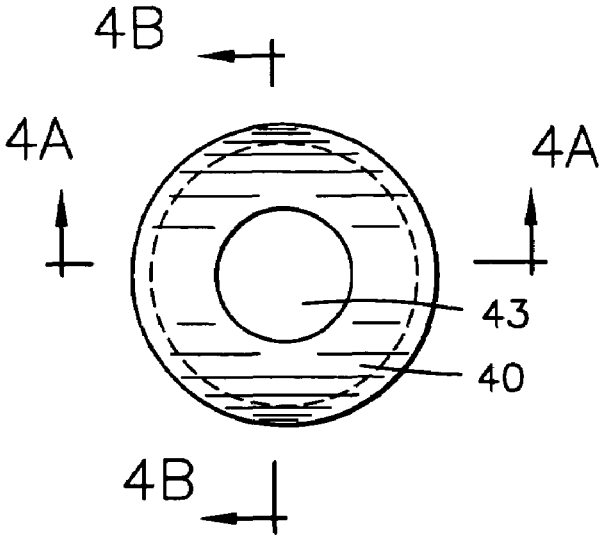
FIG. 4*c* is a top plan view of the seat of FIG. 4*a*.
Figure 6A:
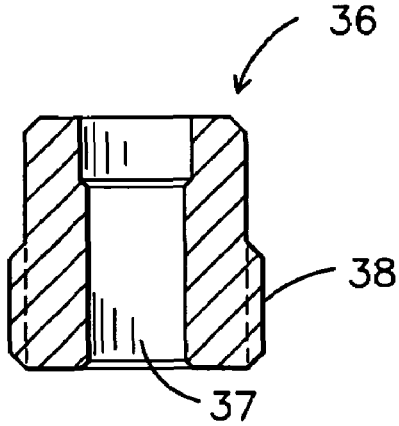
FIG. 6*a* is a sectional view of a knurled nut that may be used in the present invention.
Figure 6B:
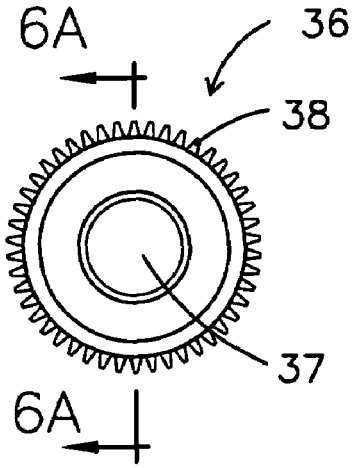
FIG. 6*b* is a top plan view of the knurled nut of FIG. 6*a*.
Figure 5A:
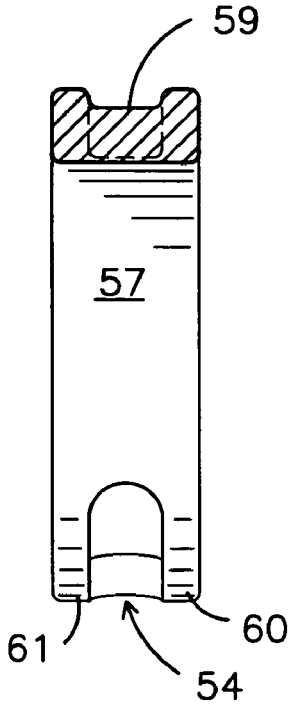
FIG. 5*a* is a partial sectional view of a handle according to the present invention.
Figure 5B:
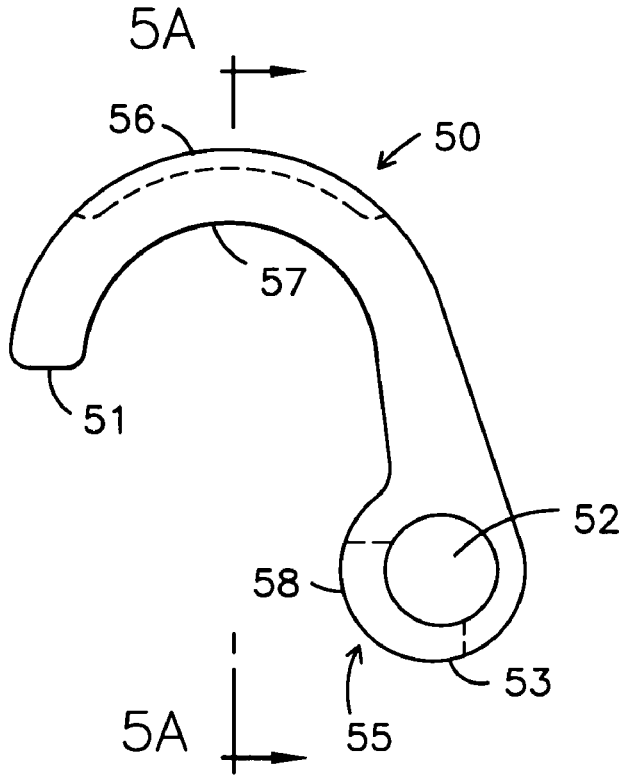
FIG. 5*b* is a top plan view of the handle of FIG. 5*a*.
Figure 5C:
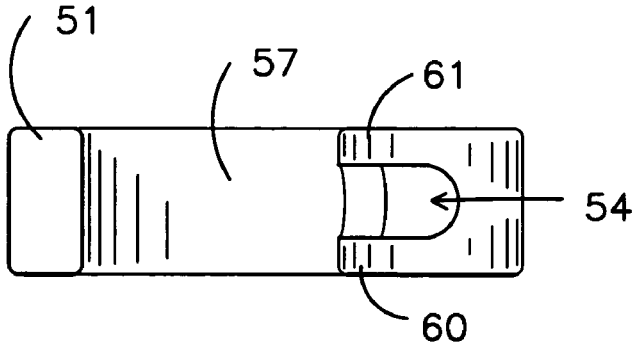
FIG. 5*c* is a side plan view of the handle of FIG. 5*a*.
Figure 7A:
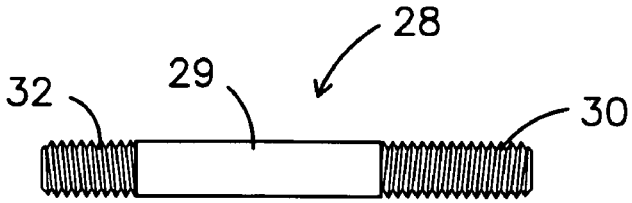
FIG. 7*a* is a side plan view of a connecting pin according to the present invention.
Figure 7B:
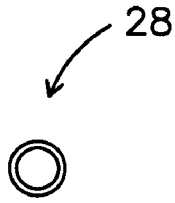
FIG. 7*b* is an end plan view of the connecting pin of FIG. 7*a*.
Figure 8A:
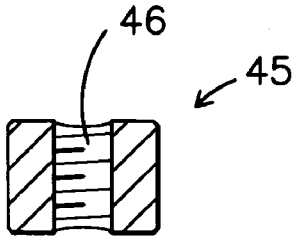
FIG. 8*a* is a sectional view of a pivot pin that may be used in the present invention.
Figure 8B:
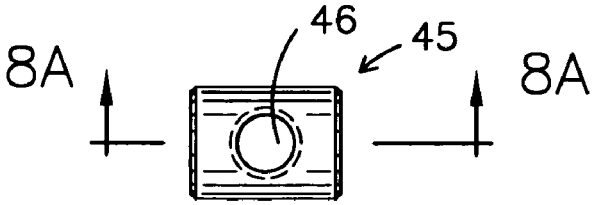
FIG. 8*b* is a top plan view of the pivot pin of FIG. 8*a*.
Figure 8C:
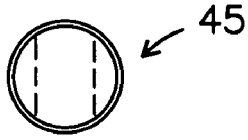
FIG. 8*c* is an end plan view of the pivot pin of FIG. 8*a*.

In FIG. 3, the handle 50 has been rotated axially so that boss 58 no longer rests upon seat 40 and pressure applied by connecting pin 28 to end nut 36 is reduced, allowing legs 18, 18' to separate and the post section to be loosened from the battery terminal. This permits the battery clamp to be loosened from the terminal. It will be seen in FIGS. 1–3 that the legs 18, 18' each having holes 22, 22' therein in registry, facilitate the placement of a connecting pin 28 therein. It will be understood that electrical power generated by the battery is transferred from battery terminals to post section 12 of battery clamp 10 and through the battery connector to the cable connecting end 11 and cable connector 14, 14' whereby power may continue on to the battery cables (not shown). Thus, the power generated by the battery is transmitted through the battery clamp 10 to the battery cable which is in turn connected to a solenoid, a starter motor, or other electrical devices.

Because the battery clamp may remain in static contact, in its tightened position, with the battery post for many years, corrosion often binds clamps to the associated battery posts and an ordinary nut and bolt securing legs 18, 18' may also rust or corrode so that it is difficult to remove the battery clamp from the battery post. The rotatable battery clamp connector of the present invention is installed by removing the standard nut and bolt connection extending between apertures 22, 22' and replacing it with a connecting pin 28 and cammed handled 50 assembly as illustrated. The connecting pin 28 has a threaded distal end 30 upon which is secured end nut 36. Spacers may be fitted about the connecting pin 28 when it is installed in order to properly position the handle structure for adequate leverage when operated, although the spacers are preferably integrally formed with other components of the assembly.

The fastener 36 may be knurled, as illustrated, or may comprise another preferably manually operable connector. The end nut 36 illustrated in FIGS. 6*a* and 6*b* has a threaded aperture 37, to be received on the threaded end 30 of connecting pin 28 and knurled surface 38 for easy gripping. The length of nut 36 is designed both to provide adequate threading for secure mounting to the connecting pin 28 and to provide proper spacing so that there is appropriate leverage exerted when the cammed handle 50 is operated. Preferably connecting pin 28 is threaded at each end and has a smooth central section that will not bind with legs 18, 18' of the yoke. Furthermore, the diameter of the pin 28 is preferably smaller than customary to further safeguard against binding. For instance, according to the present invention it is desirable to replace a standard 6 mm×lmm bolt with a 12/24 connecting pin. The size 12 machine screw provides nearly 0.06 inches additional clearance in the aperture in comparison to the 6 mm diameter bolt. A total clearance of 0.05 inches or more is preferred. The other components of the connecting pin 28 and cammed handle 50 assembly include the seat 40 and pin 45. The pin 45 is mounted in the base of handle 50 and has a threaded aperture 46 into which proximal end 32 of connecting pin 28 is secured. The seat 40 has an aperture 43 extending from a curved upper surface 42 to a substantially flat lower surface 41. After the proximal end 32 of connecting pin 28 is secured to pin 45 mounted in the base of cammed handle 50, the aperture 43 of seat 40 may be received over the connecting pin 28 with curved surface 42 of seat oriented toward the handle 50. The flat surface 41 of the seat is positioned against leg 18 of battery cable clamp and connecting pin passed through apertures 22, 22' of legs 18, 18' of battery cable clamp and then the end nut 36 is attached to the threaded end 30 of connecting pin.

The handle 50 has a base 55 with aperture 52 therein to receive pivot pin 45 and an opposite distal end 51. Intermediate the base 55 and distal end 51 is a curving handle with concave side 57 and opposite convex side 56. Convex side 56 may have a recess 59 to facilitate gripping of handle 50. The base 55 of handle 50 has a wall extending from opening 52 with boss 58 on the interior side and thinner wall 53. In addition, the base 55 has wing sections 60, 61 separated by channel 54 that permits connecting pin 28 to remain in fixed orientation while handle 50 is rotated axially about pivot pin 45 with respect to seat 40.

Thus, it may be seen that in order to assemble the rotatable connecting pin and cammed handle assembly, the pivot pin 45 is placed through aperture 52 of the base end 55 of handle 50. The first threaded end 32 of connecting pin 28 is passed through channel 54 and threaded into aperture 46 of pivot pin 45. Then, the aperture 43 of seat 40 is placed over the connecting pin 28 and connecting pin 28 is passed through apertures 22, 22' of legs 18, 18' of the battery clamp, and end nut 36 is secured to second threaded end 30 of connecting pin 28.

When end nut 36 is tightened by hand, the cammed handle 50 is preferably in its unlocked position with relatively thin walls 53 intermediate the pivot pin 45 and seat 40. In order to securely lock the post section 12 of battery clamp 10 about the terminal, the cammed handle 50 is rotated axially on pivot pin 45 so that the boss section 58 is intermediate the seat 40 and pivot pin 45 thereby exerting additional pressure on legs 18, 18' and securing the post section 12 about the terminal. This axial rotation to place the boss section 58 intermediate the pivot pin 45 and seat 40 preferably occurs in a direction normal to the surface of the battery from which the terminal post extends. The handle 50 is then in its locked position and may be rotated approximately 90° so that the concave side 57 of handle 50 at least partially encircles post section 12 of battery clamp 10 providing a compact connecting pin assembly.

Because the principal purpose of the improved connector is to address difficulties that arise due to corrosion binding parts together and other fastening issues, the design of the components should resist corrosion, and permit the fastening and unfastening of battery cables from battery terminals without the need for tools. Specifically, at least fastener 36 and seat 40 are preferably injection molded from glass-filled nylon. This material is corrosion-resistant like nylon, but has superior tensile strength and stiffness, even when subjected to high temperatures and also enjoys low thermal expansion similar to metals. The handle 58 may also be manufactured from glass-filled nylon. The use of glass-filled nylon to mold these parts not only prevents corrosion between seat 40, fastener 36 and legs 18, 18' and threads 32 of connecting pin 28, but also provides self-lubricating properties to help prevent binding of parts. In addition, connecting pin 28 preferably has a noticeably smaller diameter than apertures 22, 22' at least over its central portion 20 and passes through the apertures 22, 22' and legs 18, 18'. The connector is designed for use replacing a connecting bolt positioned intermediate the battery cable and the battery terminal post.

While the invention has been described in terms of its preferred embodiments, numerous alterations of the products and methods herein described will suggest themselves to those skilled in the art. It will be understood that the details and arrangements of the embodiments that have been described and illustrated in order to explain the nature of the invention are not to be construed as any limitation of the invention, and all such alterations which do not depart from the spirit of invention are intended to be included within the scope of the appended claims.

I claim:

1. An improved connector for a battery cable clamp of the type having a first end connected to a battery cable and first leg with a first aperture therein extending to an arcuate post section and thence to a second leg with a second aperture therein extending roughly parallel to the first leg section comprising:

(a) a handle having a first end with two parallel wings having aperatures therein and being separated by a channel, and a second opposite end;

(b) a pivot pin received within the aperatures of the parallel wings, and spanning the channel between said wings;

(c) a connecting pin having a proximal end connected through a hole of the pivot pin in the channel between the wings, said connecting pin extending through said channel away from the handle to a threaded distal end;

(d) a seat having an aperature upon which the connecting pin is received, and a cam surface which is adjacent to the parallel wings;

(e) a fastener having a threaded aperture being received on the threaded distal end of the connecting pin;

wherein the connecting pin passes through the first aperture and the second aperture intermediate the first end and the arcuate post section of the battery clamp.

2. The improved connector for a battery cable clamp of claim 1 wherein the handle has a concave side and a convex side and when lying in the plane of the post section, the concave side encircles a substantial portion of the arcuate post section of the clamp.

3. The improved connector for a battery cable clamp of claim 1 wherein at least one of the handles, the fastener and the seat is manufactured from a non-corrosive material.

4. The improved connector for a battery cable clamp of claim 3 wherein the non-corrosive material is glass-filled nylon.

5. The improved connector for a battery cable clamp of claim 1 wherein the connecting pin has an intermediate section between the proximal end and the distal end, and said intermediate section is smooth.

6. The improved connector for a battery cable clamp of claim 1 wherein the handle is rotatable axially to position a boss intermediate the pivot pin and the seat.

7. The improved connector for a battery cable clamp of claim 1 wherein the diameter of the connecting pin is at least 0.05 inches less than the diameter of the first and second apertures in the first and second legs.

8. The improved connector for a battery cable clamp of claim 2 wherein the handle is rotatable laterally to a position normal to the plane of the post section.

9. An improved battery cable clamp comprising:

(a) a first end having a cable section with cable connectors to secure a battery cable;

(b) a first leg section extending therefrom and having a first aperture therein;

(c) a post section connected to said first leg section and defining a cavity to receive a battery post;

(d) a second leg section extending from the post section and having a second aperture therein such that the first and second apertures are axially aligned;

(e) a connecting pin passing through the axially aligned aperatures in the legs, having a proximal end and a distal end;

(f) a handle having first end with a pair of parallel wings having apertures therein which receive a pivot pin, said wings being separated by a channel and said handle having a second opposite end;

(g) the pivot pin having a hole and being connected to the proximal end of the connecting pin through the channel;

(h) a seat having a cam surface and an aperature receiving the connecting pin, and being positioned between the pair of legs and the pivot pin; and (i) a fastener connected to the distal end of the connecting pin.

10. The improved battery cable clamp of claim 9 wherein at least one of the handles, the fastener and the seat is manufactured from a non-corrosive material.

11. The improved battery cable clamp of claim 9 wherein the handle has a concave side and a convex side and when lying in the plane of the post section, the concave side encircles a substantial portion of the arcuate post section of the clamp.

12. The improved battery cable clamp of claim 11 wherein at least one of the handles, the fastener and the seat is manufactured from a non-corrosive material.

13. The improved battery cable clamp of claim 12 wherein the non-corrosive material is glass-filled nylon.

14. The improved battery cable clamp of claim 9 wherein the connecting pin has an intermediate section between the proximal end and the distal end, and said intermediate section is smooth.

15. The improved battery cable clamp of claim 9 wherein the handle is rotatable axially to position a boss intermediate the pivot pin and the seat.

16. The improved battery cable clamp of claim 9 wherein the diameter of the connecting pin is at least 0.05 inches less than the diameter of the first and second apertures in the first and second legs.

17. The improved battery cable clamp of claim 9 wherein the handle is rotatable laterally to a position normal to the plane of the post section.

18. A method for connecting a battery cable clamp of the type having a first end having a cable section with a cable connector to secure a battery cable; a first leg section extending therefrom and having a first aperture therein; a post section connected to said first leg section and defining a cavity to receive a battery post; a second leg section extending from the post section and having a second aperture therein such that the first and second apertures are axially aligned; using a rotatable connecting pin and cammed handle assembly and comprising the steps of:

(a) placing a pivot pin through an aperture in a base end of a handle;

(b) attaching a first proximate end of a connecting pin to a hole in the pivot pin through a channel formed between two parallel wings in the base so that said connecting pin extends from the base of the handle;

(c) placing a seat with a concave surface facing the base end of the handle on the connecting pin and passing the connecting pin through the first and second apertures of the first and second legs;

(d) fastening an end nut on a distal end of the connecting pin; and (e) rotating the handle axially so that a boss section of the base is interposed between the pivot pin and the concave surface of the seat, thereby compressing the first and second legs.

19. The method of claim 18 further comprising the steps of rotating the handle laterally so that a concave surface of the handle substantially encircles the post section.

* * * * *